10/15/85 OR 4,546,585

United States Patent [19]

Governale

[11] Patent Number: 4,546,585

[45] Date of Patent: Oct. 15, 1985

[54] DOOR PANEL AND METHOD OF MAKING

[75] Inventor: Bernard C. Governale, Duluth, Ga.

[73] Assignee: Peachtree Doors, Inc., Norcross, Ga.

[21] Appl. No.: 519,504

[22] Filed: Aug. 2, 1983

[51] Int. Cl.[4] ..... E04C 1/00; E04C 2/00; E06B 3/70

[52] U.S. Cl. ..... 52/309.11; 52/455; 52/741; 52/811

[58] Field of Search ..... 52/309.11, 309.9, 455, 52/741, 811

[56] References Cited

U.S. PATENT DOCUMENTS 4,183,393 1/1980 Bailey ..... 52/309.11

4,327,535 5/1982 Governale ..... 52/309.11

4,441,301 4/1984 Benson ..... 52/309.11 X

*Primary Examiner*—Michael R. Lusignan

*Attorney, Agent, or Firm*—Kimmel, Cromwell & Weaver

[57] ABSTRACT

A metal clad foam-filled fabricated door panel utilizes scrap metal generated in another product line to form a simulated stile and rail door having a very realistic appearance. The stile and rail metal cladding components are mechanically held together by swedging until wooden framing elements are installed and glazing is completed. Foaming of the panel is then carried out and all components are strongly bonded in assembled relationship by the cured foam.

2 Claims, 8 Drawing Figures

FIG. 1
PRIOR ART
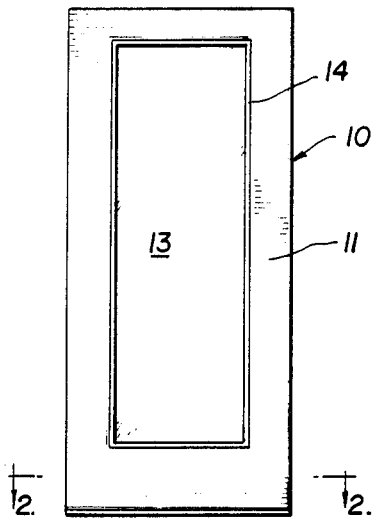
FIG. 3
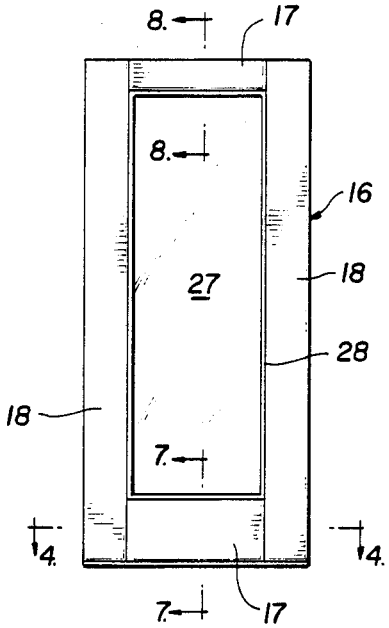
FIG. 6
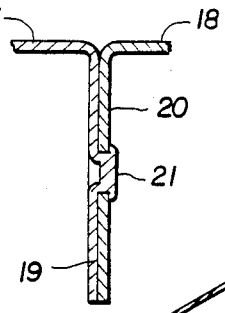
FIG. 7
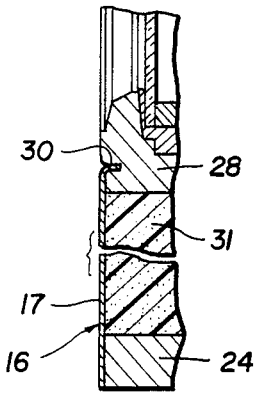
FIG. 8
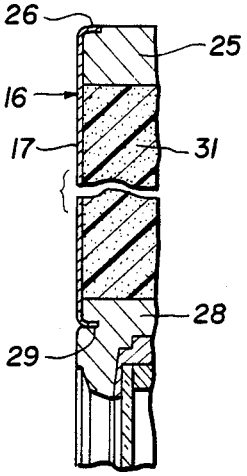
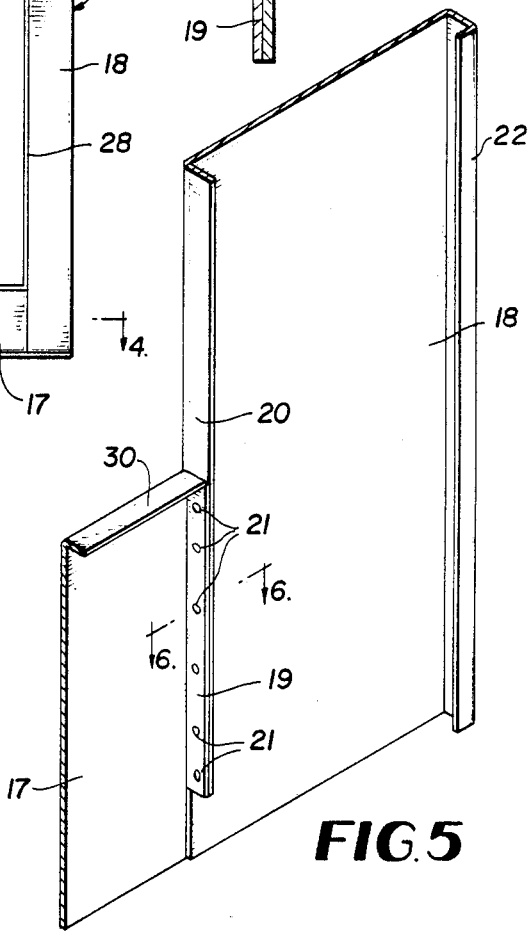
FIG. 5
FIG. 2
PRIOR ART
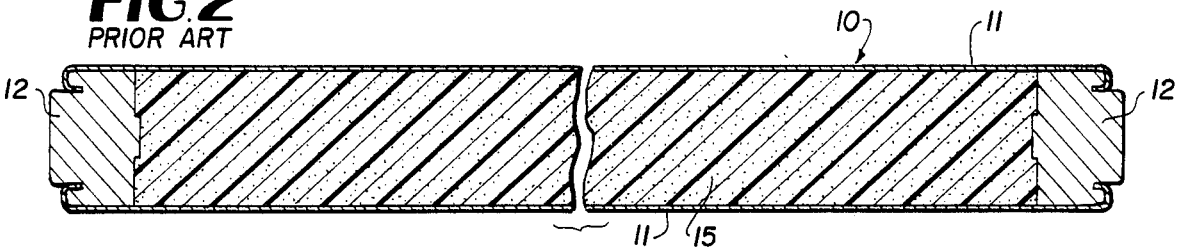
FIG. 4
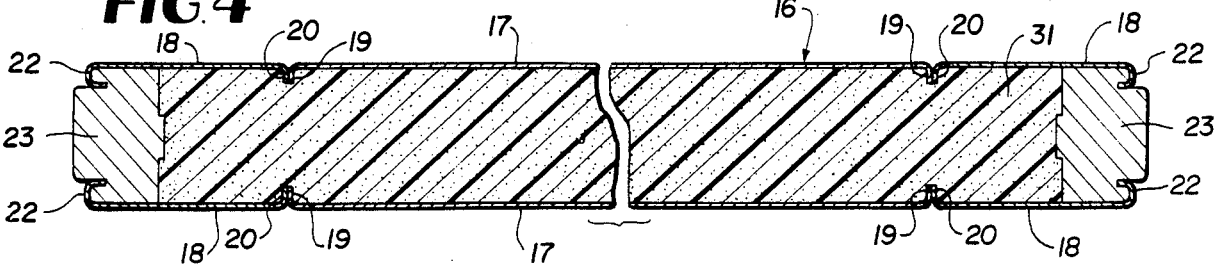

DOOR PANEL AND METHOD OF MAKING

BACKGROUND OF THE INVENTION

Fabricated foam-filled metal clad doors and doorway panels are known. When such doors are equipped with a large lite panel, the sheet metal which is blanked out to make way for the glazing assembly becomes scrap material which is ordinarily wasted.

In accordance with the present invention, it has been found that this scrap metal generated in connection with a different product line can be beneficially and economically utilized in the construction of doors and doorway panels of improved appearance which very closely resemble the appearance of true stile and rail wooden doors. Thus, the utilization of the scrap material from one product line is not only used economically in producing a second product line, but its use enhances the quality and saleability of the second product line in a meaningful way.

Additionally, according to the invention, a unique mode of assembly of components is provided in which parts are temporarily held in assembled relationship by a simple and economical mechanical means and are subsequently permanently united by the adhesive bonding effect of the injected foam.

Other features and advantages of the invention will become apparent during the course of the following detailed description.

BRIEF DESCRIPTION OF THE DRAWINGS

FIG. 1 is an elevational view of a glazed metal clad foam-filled door panel according to the prior art.

FIG. 2 is an enlarged fragmentary horizontal section taken on line 2—2 of FIG. 1.

FIG. 3 is a view similar to FIG. 1 showing a door according to the present invention.

FIG. 4 is a fragmentary horizontal section taken on line 4—4 of FIG. 3.

FIG. 5 is a fragmentary perspective view of mechanically connected rail and stile metal cladding according to the invention.

FIG. 6 is an enlarged fragmentary horizontal section taken on line 6—6 of FIG. 5.

FIG. 7 is a fragmentary vertical section taken on line 7—7 of FIG. 3.

FIG. 8 is a similar section taken on line 8—8 of FIG. 3.

DETAILED DESCRIPTION

Referring to the drawings in detail wherein like numerals designate like parts, a door or doorway panel 10 in accordance with the prior art has metal cladding 11 on both faces thereof, the cladding at its margins being interlocked with wooden stiles 12, FIG. 2, and being similarly secured to top and bottom wooden rails, not shown. The prior art door 10 has a large central lite 13 incorporated in a wooden light frame 14, forming a lite assembly which is installed in the door by known techniques. In providing for the reception of the framed lite 13, large rectangular sections of sheet metal must be blanked out on opposite faces of the door and become scrap, which customarily is never used. The completed door 10 has a rigid foam core 15 shown in FIG. 2, preferably urethane foam, which is thermally efficient, lightweight and also serves to bond the metal and wooden door components in permanently assembled relationship.

The door 10 on its opposite sides possesses seamless metal cladding entirely around the rectangular margin of the lite assembly. While neat and attractive in appearance, the door 10 lacks the traditional appearance of a wooden rail and stile door.

In accordance with the present invention, the scrap material generated in the production of the door 10 is utilized in the construction of a door 16 according to this invention. As shown in FIG. 3, both faces of the door 16 have the appearance of a true rail and stile wooden door, although in actuality the door 16 is metal clad and foam-filled, as will be described.

The metal cladding on each face of the door 16 comprises top and bottom wood rail simulating sections 17 formed entirely of the scrap generated in the production of the door 10, and also comprises vertical stile simulating sections 18 which are not scrap material.

In the construction of the door 16, the top and bottom metal sections 17 on the opposite faces of the door are joined by their narrow right angular end flanges 19 with opposing side longitudinal flanges 20 of the stile simulating metal sections 18. The flanges 19 and 20 are secured together in contacting relationship by mechanical swedging or upsetting at spaced points, as indicated at 21 in the drawings. The swedging forms a sufficient mechanical connection to hold the metal parts together during the remainder of the assembly procedure, following which the interior of the fabricated door is foamed with urethane, and the strong bonding action inherent in the foam locks all of the wooden and metal components permanently and strongly in assembled relationship.

The mechanical joint shown in FIGS. 5 and 6 is repeated at each of the four corners of the door on both of its faces. U-flanges 22 are formed along the outer margins of each metal section 18 to interlock with wooden stiles 23 which extend for the full height of the door 16 along both of its vertical edges. As shown in FIGS. 7 and 8, bottom and top wooden rails 24 and 25 are provided, and at least the top rail 25 is customarily lapped by a narrow right angular flange 26 formed at the top of each upper metal section 17. A preassembled lite panel 27 having a marginal wooden frame 28 is provided in accordance with conventional techniques. Lower flanges 29 of upper metal sections 17 and top horizontal flanges 30 of lower metal sections 17 enter grooves formed around the rectangular lite frame 28 on both of its faces in accordance with conventional practice.

The connections afforded between the metal cladding sections at 21 hold the metal parts together during installation of the wooden stiles 23 and rails 24 and 25 and also during installation of the framed lite panel 27. When this assembly work is all completed, the urethane foam core 31 is injected and allowed to harden and when this is completed all of the described metal and wood components are permanently and strongly bonded together.

The resulting door 16, FIG. 3, utilizes scrap entirely generated in making the door 10 for the four opposite side top and bottom sections 17 which closely resemble the appearance of rails in the traditional wooden rail and stile door. The non-scrap vertical metal sections 18 on opposite sides of the door 16 closely resemble wooden stiles in their appearance.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A door panel or the like comprising top and bottom horizontal rail simulating metal sections on opposite faces of the door panel and opposite side vertical stile simulating metal sections on opposite faces of the door panel, the rail simulating metal sections having opposite end integral right angular flanges which extend inwardly from opposite faces of the door panel, the stile simulating metal sections having interior side integral right angular flanges which extend inwardly of said opposite faces of the door panel in side-by-side abutting relationship with the flanges of the rail simulating metal sections, the flanges of the rail and stile simulating metal sections being mechanically connected by swedging to form a sufficiently secure connection between the rail and stile simulating metal sections on the opposite faces of the door panel to enable completion of the construction of the door panel without separation of the rail and stile simulating metal sections, the rail and stile simulating metal sections on the opposite faces of the door panel also having integral longitudinal flanges at least along their exterior longitudinal edges and extending inwardly of such edges, top and bottom horizontal wooden rails and opposite side vertical wooden rails installed between the rail and stile simulating metal sections on the opposite faces of the door panel and having interlocking engagement with said integral longitudinal flanges, a framed lite assembly in the rectangular space defined by the top and bottom rail simulating metal sections and the opposite side stile simulating metal sections on the opposite faces of the door panel and having interlocking engagement with said longitudinal flanges, and a core of substantially rigid foam filling the interior space between the rail and stile simulating metal sections on the opposite faces of the door panel and around the framed lite assembly and between the latter and said top and bottom horizontal and opposite side vertical wooden rails, said core permanently and securely bonding all of the metal sections, wooden rails and framed lite assembly in unitized relationship.

2. A method of making a door panel or the like comprising the steps of mechanically joining top and bottom horizontal rail simulating metal sections with opposite side vertical stile simulating metal sections on the opposite faces of a door panel being made and thereby forming connections between said metal sections of sufficient strength only to hold them together during the remaining steps of the method, installing top and bottom horizontal and opposite side vertical wooden rails between the rail and stile simulating metal sections on the opposite faces of said door panel in interlocked relationship with flanges of the metal sections, installing a framed lite panel within an interior space defined by the inner margins of the rail and stile simulating metal sections on the opposite faces of the door panel in interlocked relationship with other flanges of the metal sections, and then foaming the interior space between all of the metal sections on the opposite faces of the door panel and around the framed lite panel to effect permanent secure bonding and unification of all of the metal and wood components of the door panel.

* * * * *